US007438174B2

(12) United States Patent
Aulanko et al.

(10) Patent No.: US 7,438,174 B2
(45) Date of Patent: Oct. 21, 2008

(54) TRAVELATOR, MOVING RAMP OR ESCALATOR

(75) Inventors: Esko Aulanko, Kerava (FI); Jorma Mustalahti, Hyvinkää (FI); Marc Ossendorf, Bochum (DE)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 11/606,924

(22) Filed: Dec. 1, 2006

(65) Prior Publication Data

US 2007/0074950 A1 Apr. 5, 2007

Related U.S. Application Data

(63) Continuation of application No. PCT/FI2005/000213, filed on May 10, 2005.

(30) Foreign Application Priority Data

Jun. 2, 2004 (FI) ..... 20040754

(51) Int. Cl.
*B66B 20/00* (2006.01)

(52) U.S. Cl. ..... 198/321

(58) Field of Classification Search ..... 198/321–338
See application file for complete search history.

(56) References Cited

U.S. PATENT DOCUMENTS

| | | | | |
|---|---|---|---|---|
| 4,159,758 | A | 7/1979 | Courson et al. | |
| 4,488,631 | A | 12/1984 | Courson et al. | |
| 4,842,122 | A * | 6/1989 | Van Nort | 198/335 |
| 4,889,222 | A | 12/1989 | Kanamori et al. | |
| 4,953,686 | A * | 9/1990 | Rulke | 198/332 |
| 5,215,177 | A * | 6/1993 | Johnson et al. | 198/335 |
| 5,542,522 | A * | 8/1996 | Adrian et al. | 198/337 |
| 5,601,179 | A | 2/1997 | Wente et al. | |

FOREIGN PATENT DOCUMENTS

DE 100 24 166 A1 11/2001

OTHER PUBLICATIONS

Search Report from Finnish Patent Application No. FI 20040754, dated May 10, 2004.

* cited by examiner

*Primary Examiner*—Mark A Deuble
(74) *Attorney, Agent, or Firm*—Venable LLP; Robert Kinberg; Steven J. Schwarz

(57) ABSTRACT

A people mover includes a conveyor and a protective skirting made from an extruded metal profile. The protective skirting is located adjacent to a side of the conveyor, with a narrow gap located between the protective skirting and the side to prevent objects from entering the gap when the conveyor is moving.

13 Claims, 3 Drawing Sheets

TRAVELATOR, MOVING RAMP OR ESCALATOR

CROSS-REFERENCE TO RELATED APPLICATIONS

The present application is a continuation of International Application No. PCT/FI2005/000213, filed May 10, 2005, which claims priority of FI20040754, filed in Finland on Jun. 2, 2004, the priority of which is also claimed herein. The entire content of the aforementioned applications is incorporated herein by reference.

BACKGROUND

The present application relates generally to a travelator, moving ramp, escalator, or the like, also collectively referred to herein as a "people mover." More particularly, the application relates to a protective skirting for such an apparatus. In the prior art, a travelator, moving ramp, escalator, or the like, is known which comprises a conveyor and a fixed protective skirting placed beside the conveyor. The gap between the protective skirting and the conveyor is often relatively narrow to prevent objects from getting into the gap when the conveyor is moving.

The travelator, moving ramp, escalator, or the like, typically has an interior cladding. Usually, the protective skirting and interior cladding are separate parts. The skirting usually consists of straight or bent sheet metal. Mounting and dismounting the protective skirting can be a very time-consuming task.

SUMMARY

An object of the invention is to overcome the above-mentioned drawbacks of the prior art.

Another object is to provide a skirting of economically advantageous construction that is easy to mount and dismount so that the time required for assembly and disassembly is reduced and cost savings can be achieved.

According to one embodiment, a people mover comprises a conveyor; and a protective skirting made from an extruded metal profile, the protective skirting located adjacent to a side of the conveyor, with a narrow gap located between the protective skirting and the side to prevent objects from entering the gap when the conveyor is moving.

In another embodiment, the protective skirting can be made from an extruded metal profile. This embodiment has the advantage that the protective skirting formed from extruded metal profile can be easily shaped in an appropriate manner so that it will be easy to mount and dismount. Additionally, several functions can be integrated into one part so that the assembly and disassembly of the protective skirting is made fast and easy.

In an another embodiment, the protective skirting is made of light alloy, such as aluminum or an aluminum alloy.

In another embodiment, the protective skirting comprises a number of mutually identical protective skirting profile pieces connected together end-to-end in series.

In another embodiment, the travelator, moving ramp, escalator, or the like comprises a frame structure to which the protective skirting is designed to be fastened with fastening bolts or the like. The fastening bolts may be quick-release, quarter-turn fastening bolts (such as those available from Dzus Fasteners, England).

In another embodiment, the metal profile forming the protective skirting comprises one or more of the following items integrated with it: an external wall forming the outwardly visible outer surface of the protective skirting; a bolt slot made in the external wall and opening inwards to receive the head of a fastening bolt or the like; a channel for a joint pin for joining the protective skirting profile pieces together end-to-end;

reinforcing flanges which together with the external wall form at least one box-like space inside the protective skirting piece; and/or joining means for joining the metal profile piece to the frame structure.

In another embodiment, the joining means comprises a handrail fastening element for fastening a handrail to the frame structure. The handrail fastening element comprises a projection extending towards the bolt slot. The projection includes a hole for receiving the head of the fastening bolt in the bolt slot.

In another embodiment, the joining means comprises a first flange in the upper part of the skirting profile piece, and a first groove in the upper part of the handrail fastening element. The groove is adapted to receive the first flange.

In another embodiment, the joining means comprises a second flange in the frame structure, and a second groove in the lower part of the skirting profile piece. The second groove is adapted to receive the second flange.

In another embodiment, the second flange and the second groove are adapted to extend at a sharp angle relative to the horizontal direction. The angle can determine the mounting angle of the skirting profile piece relative to the frame structure.

In another embodiment, the first flange and the first groove are adapted to extend at the same angle relative to the horizontal direction as the second flange and the second groove.

In another embodiment, the travelator, moving ramp, escalator, or the like is of the low-construction type, and has a frame structure designed to be mounted on a fixed base, such as a floor or other support.

The protective skirting of the invention can be coated with friction reducing material, for example, Teflon or similar material, to lessen the inconvenience or annoyance experienced by a passenger who happens to touch the protective skirting. The protective skirting can be anodized or treated in other ways to create a hard and/or smooth and/or slippery surface. Additionally or alternatively, the protective skirting can be treated to make it suitable for application of a friction reducing coating and/or some other type of coating, e.g., a decorative coating. Decorative patterns or the equivalent can also be created in connection with anodization or other treatment modifying the surface of the material of the protective skirting.

BRIEF DESCRIPTION OF THE DRAWINGS

In the following, the invention will be described in detail with reference to exemplary embodiments, referencing the attached drawings, wherein.

DETAILED DESCRIPTION

Figure 1:
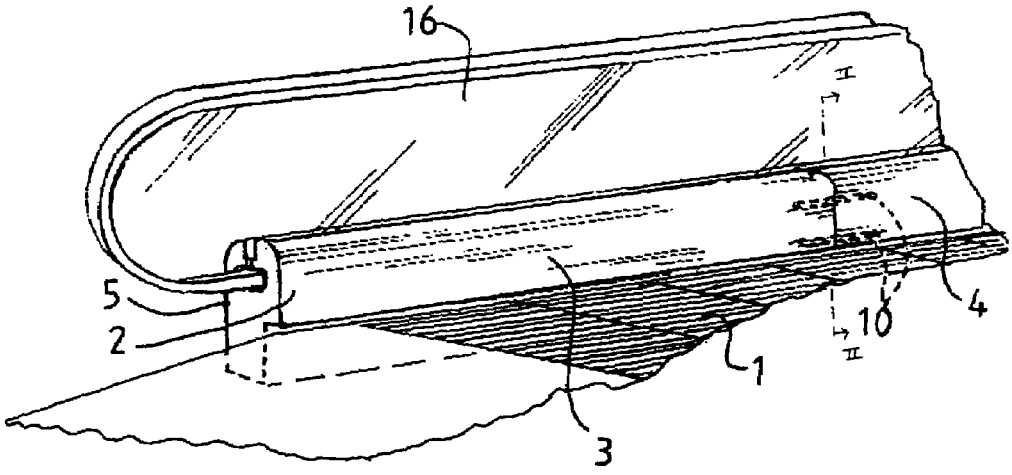
FIG. 1 is a partial, perspective representation of an exemplary travelator.

FIG. 1 shows a low-construction travelator, designed to be mounted on a fixed base, such as a floor or other support. The figure shows only a partial view of the travelator, and only one half of it. The opposite half, which is not visible in the figure, can be a mirror image of the half shown in the figure. As used herein, "low-construction" means that no pit has to be made in the fixed base for the travelator machinery. In the following description of exemplary embodiments, the invention is described with reference to a travelator, but it is obvious that corresponding principles of the invention are also applicable to moving ramps, escalators, and the like.

For convenience, all of these types of apparatuses are referred to collectively as "people movers" herein.

The travelator comprises a conveyor 1, which may be, for example, a pallet conveyor or a belt conveyor. The travelator comprises a frame structure 5, which can rest on a floor. Attached to the fixed structure 5 is a protective skirting 2, which extends longitudinally alongside the conveyor 1. A substantially narrow gap (about 3-4 mm) may be formed between the protective skirting 2 and the upper surface of the travelator, for example, to prevent the shoes of passengers using the conveyor from becoming stuck and wedged in the gap. The outer surface of the protective skirting 2 can be smooth and even so that objects will not easily adhere to it. The protective skirting 2 also forms an interior cladding having a pleasant appearance. The protective skirting 2 comprises a number of skirting profile pieces 3, 4 of mutually identical cross-section and suitable length connected together one-after-the-other and end-to-end. The skirting profile pieces can be formed by extruding from a light metal alloy, such as aluminum or an aluminum alloy.

Figure 2:
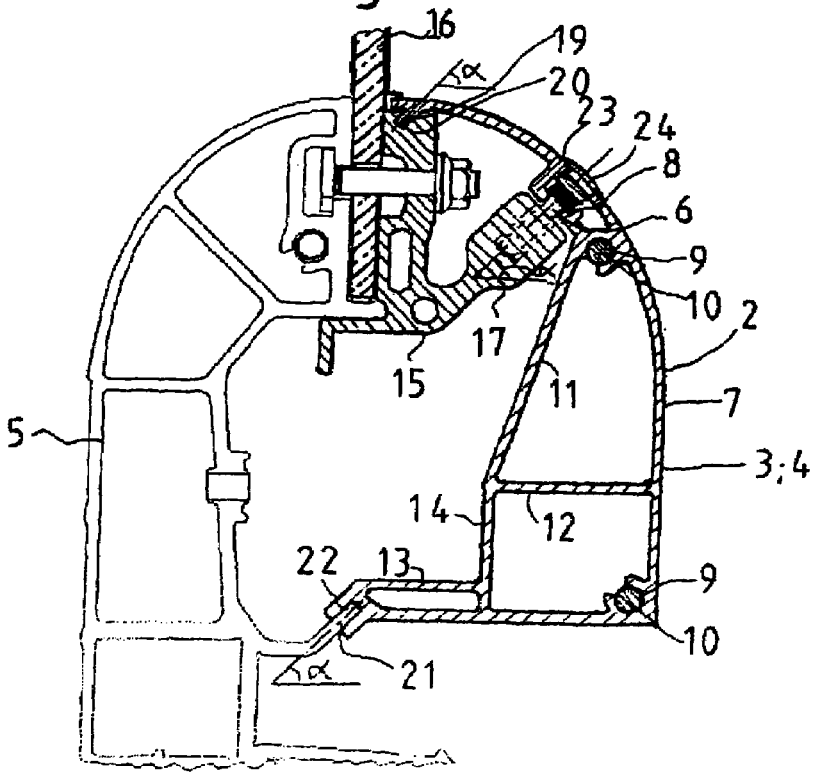
FIG. 2 is a cross-sectional representation taken along lines II-II of FIG. 1, illustrating the fastening of the protective skirting to the frame structure.
Figure 3:
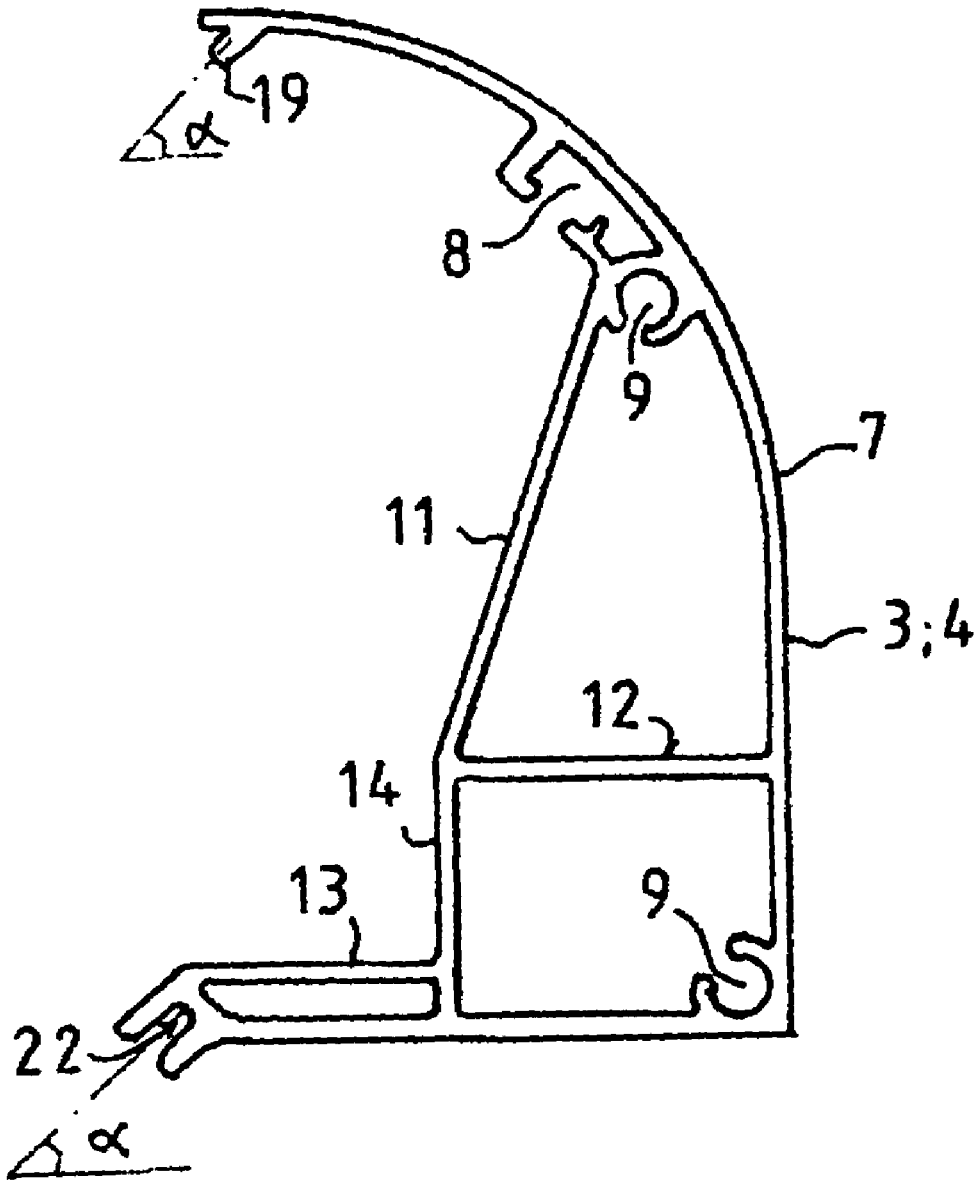
FIG. 3 shows a profile shape of the skirting profile piece of FIG. 2.

FIG. 3 shows the profile of the protective skirting, and FIG. 2 shows how a skirting profile piece 3, 4 like this is secured.

The skirting profile piece 3, 4 forming the protective skirting 2 can combine many different functionalities into one piece. Integrated in the skirting profile piece 3, 4 is an external wall 7, which can form the outwardly visible surface of the protective skirting 5. In addition, the skirting profile piece comprises a bolt slot 8 provided in the external wall 7 and opening inwards to receive the head of a fastening bolt 6, or the like. Furthermore, the skirting profile piece comprises a channel 9 for a joint pin 10 for the alignment and connection of the skirting profile pieces 3, 4 to each other in end-to-end fashion. Moreover, the skirting profile piece comprises reinforcing flanges 11, 12, 13, 14 which, together with the external wall 7, form at least one box-like space within the skirting profile piece, thus making the skirting profile very stiff and stable in shape. In the box-like space, it is possible to place, for example, electric conductors for conducting electricity to a skirting light (not shown) that may be set into the skirting profile.

Figure 4:
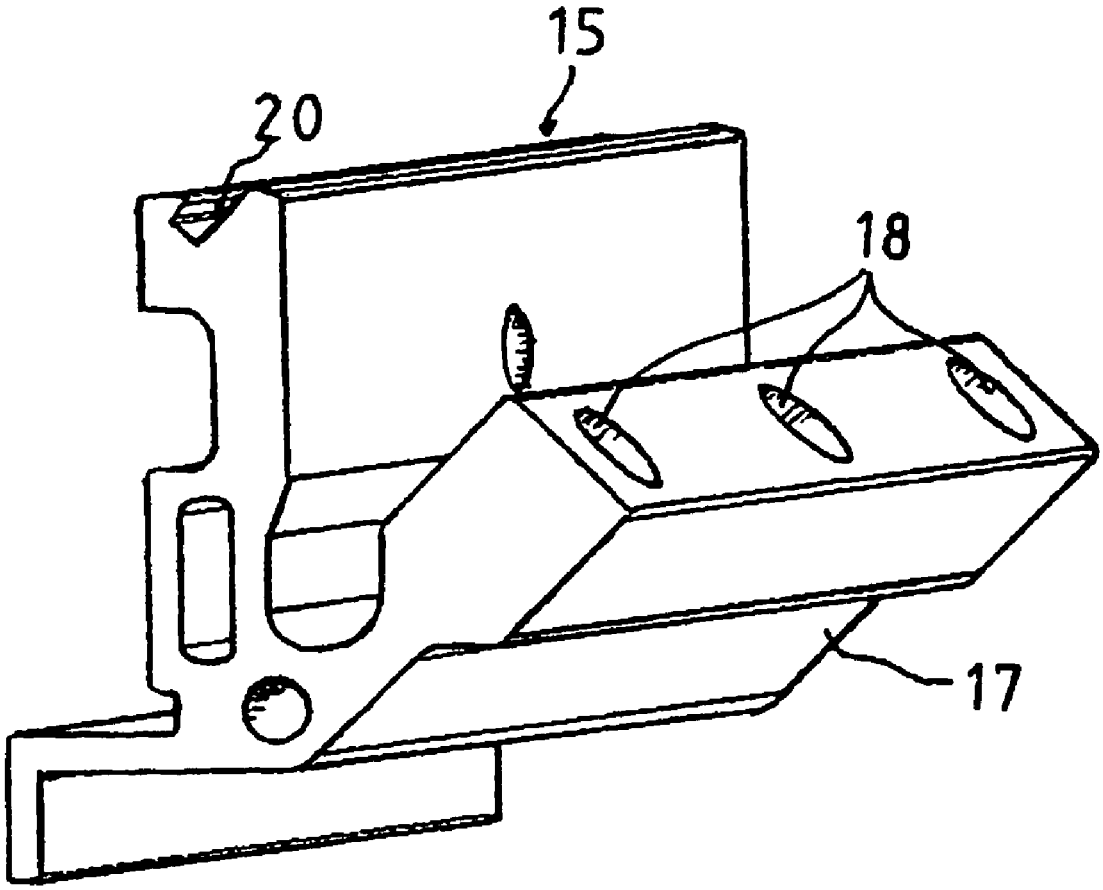
FIG. 4 is a perspective representation of a handrail fastening element of FIG. 2, to which the protective skirting can be fastened

As can be seen from FIGS. 2 and 4, the skirting profile piece 3, 4 can be joined to the frame structure 5 by utilizing a handrail fastening element 15, which can also be used for fastening a handrail 16 to the frame structure 5. As shown in FIG. 2, the frame plate of the handrail 16 is firmly secured with a bolted joint between the stop faces of the frame structure 5 and the handrail fastening element 15.

For securing the skirting profile piece 3, 4, the handrail fastening element comprises a projection 17 extending at an angle (alpha) towards the bolt slot 8. The projection 17 can include a hole 18 (see FIG. 4) to receive the head of a fastening bolt 6 in the bolt slot 8. If the fastening bolt 6 is an ordinary threaded bolt, then the hole can include an inner thread. Alternatively, the skirting profile piece 3, 4 can be secured using quick-release bolts 6, such as quarter-turn fasteners (which can be secured/released by turning them a quarter of a turn), for example, of the "Dzus fastener" type. According to an embodiment using quick release bolts, the sleeve part of the quick fastening device can be placed inside the hole 18. To allow the fastening bolt 6 to be mounted, an access hole 23 is located in the area of the bolt slot 8. The access hole 23 can be covered with a plug 24, as shown in FIG. 2.

Still referring to FIGS. 2 and 3, to allow joining of the skirting profile piece 3, 4, each profile can include in its upper part a first flange 19 directed downwards at angle (alpha) with respect to horizontal. The handrail fastening element 15 can have a first groove 20 in its upper part. Groove 20 can be adapted to receive the first flange 19, and can be at the same angle a. Further, the frame structure 5 can include a second flange 21, which can be directed obliquely upwards at angle (alpha). Correspondingly, the lower part of the skirting profile piece 3, 4 can be provided with a second groove 22, which can be directed obliquely upwards at angle (angle), and can be adapted to receive the second flange 21. The angle (alpha) determines the orientation in which the skirting profile piece 3, 4 is mounted relative to the frame structure 5. Thus, in the embodiment shown, the mounting direction is obliquely downwards. In the embodiment shown, this angle (alpha) is about 450.

FIG. 4 shows an embodiment of the handrail fastening element 15, wherein the handrail fastening element is a short profiled piece. Multiple profiled pieces 15 like this can be arranged in a spaced-apart fashion. According to an alternative embodiment, the handrail fastening element 15 can be implemented as a single, long profiled piece extending substantially throughout the length of the protective skirting 2.

The present invention is not limited to the exemplary embodiments described above. Instead, many variations are possible within the scope of the inventive concept defined in the claims.

What is claimed is:

1. A people mover, comprising:

a frame structure;

a conveyor;

a protective skirting made from an extruded metal profile, the protective skirting located adjacent to a side of the conveyor, with a narrow gap located between the protective skirting and the side to prevent objects from entering the gap when the conveyor is moving;

a flange located on the frame structure, the flange extending in a plane located at an acute angle with respect to horizontal; and a groove on the protective skirting, wherein the flange and groove form a connection, whereby a mounting direction for the protective skirting is obliquely downward with respect to horizontal.

2. The people mover of claim 1, wherein the protective skirting is made from an alloy selected from the group consisting of aluminum and aluminum alloy.

3. The people mover of claim 1, wherein the protective skirting comprises a plurality of protective skirting profile pieces connected together end-to-end in series.

4. The people mover of claim 3, wherein the protective skirting is adapted to be fastened to the frame structure using fasteners.

5. The people mover of claim 4, wherein the metal profile forming the protective skirting is integrated with at least one of the following items:

an external wall forming an outwardly visible outer surface of the protective skirting;

a bolt slot located in the external wall and opening inwards, the bolt slot adapted to receive a head of a fastener;

a channel adapted to receive a joint pin to join adjacent skirting profile pieces together end-to-end, at least one reinforcing flange that cooperates with the external wall to form at least one box-like space inside the protective skirting piece, and joining means for joining the metal profile piece to the frame structure.

6. The people mover of claim 1, further comprising a frame structure adapted to be mounted on a fixed base.

7. A people mover, comprising:

a conveyor;

a protective skirting made from an extruded metal profile, the protective skirting located adjacent to a side of the conveyor, with a narrow gap located between the protective skirting and the side to prevent objects from entering the gap when the conveyor is moving; and a frame structure, wherein the protective skirting is adapted to be fastened to the frame structure using fasteners;

wherein the protective skirting comprises a plurality of protective skirting profile pieces connected together end-to-end in series;

wherein the metal profile forming the protective skirting is integrated with at least one of the following items:

an external wall forming an outwardly visible outer surface of the protective skirting;

a bolt slot located in the external wall and opening inwards, the bolt slot adapted to receive a head of a fastener;

a channel adapted to receive a joint pin to join adjacent skirting profile pieces together end-to-end, at least one reinforcing flange that cooperates with the external wall to form at least one box-like space inside the protective skirting piece, and joining means for joining the metal profile piece to the frame structure wherein the metal profile forming the protective skirting is integrated with at least the bolt slot and the joining means, and the joining means comprises a handrail fastening element adapted for fastening a handrail to the frame structure, the handrail fastening element comprising a projection that extends towards the bolt slot, and a hole for receiving the fastener arranged in the bolt slot.

8. The people mover of claim 7, wherein the joining means comprises a first flange in an upper part of the skirting profile piece, and a first groove in an upper part of the handrail fastening element adapted to receive the first flange.

9. The people mover of claim 8, wherein the joining means further comprises a second flange in the frame structure, and a second groove in a lower part of the skirting profile piece adapted to receive the second flange.

10. The people mover of claim 9, wherein the second flange and the second groove extend at an angle (alpha) relative to the horizontal direction, said angle (alpha) determining a mounting angle between the skirting profile piece and the frame structure.

11. The people mover of claim 10, wherein the first flange and the first groove extend at the angle (alpha) with respect to the horizontal direction.

12. The people mover of claim 1, further comprising a surface treatment on the protective skirting, the surface treatment selected from the group consisting of a friction reducing material, and anodization.

13. The people mover of claim 7, wherein the protective skirting is secured to the frame structure by the handrail fastening element.

* * * * *